United States Patent [19]

Tattanelli et al.

[11] Patent Number: 4,667,381

[45] Date of Patent: May 26, 1987

[54] FLAT MULTIPLE PAIR CABLE STRIPPING AND CONNECTOR ATTACHING APPARATUS

[75] Inventors: Robert Tattanelli, Brooklyn, N.Y.; Steven R. Thomas, Bridgewater, N.J.

[73] Assignee: GK Technologies, Incorporated, Greenwich, Conn.

[21] Appl. No.: 755,472

[22] Filed: Jul. 16, 1985

[51] Int. Cl.[4] ..... H01R 43/04

[52] U.S. Cl. ..... 29/33 M; 29/564.4; 29/749

[58] Field of Search ..... 29/566.3, 566.4, 33 M, 29/750, 751, 752, 749, 857, 861, 564.4

[56] References Cited

U.S. PATENT DOCUMENTS

| | | | |
|---|---|---|---|
| 3,832,767 | 9/1974 | Petree | 29/564.4 X |
| 4,351,110 | 9/1982 | Folk | 29/749 |
| 4,409,713 | 10/1983 | Johnson | 29/33 M |
| 4,411,062 | 10/1983 | Folk et al. | 29/749 |
| 4,441,251 | 4/1984 | Grubb | 29/749 X |

*Primary Examiner*—Z. R. Bilinsky

*Attorney, Agent, or Firm*—Hopgood, Calimafde, Kalil, Blaustein & Judlowe

[57] ABSTRACT

Apparatus for attaching insulation penetrating connectors to the ends of flat multiple pair cables has a sheath stripping station and a connector attaching station. Spaced knives slit the sheath crosswise of the cable and translate in the direction of the cable to strip the sheathing while conductor separating and engaging combs engage on each side of the cable one conductor of each pair of conductors prior to complete removal of the severed sheath end but operative upon complete sheath removal to separate the conductors into two planar arrays diverging in opposite directions from the general plane of the cable. A carriage holding the cable with bared end is arranged to translate from the sheath stripping station to the connector attaching station where connector holding jaws are articulable for the purpose. The carriage has a cross-slide permitting the diverging arrays of conductors to be advanced into juxtaposition with a connector held within said jaws, and wire cutting and inserting fingers are articulably mounted for cutting and installing the wire ends in the connector.

9 Claims, 23 Drawing Figures

Fig. 4.
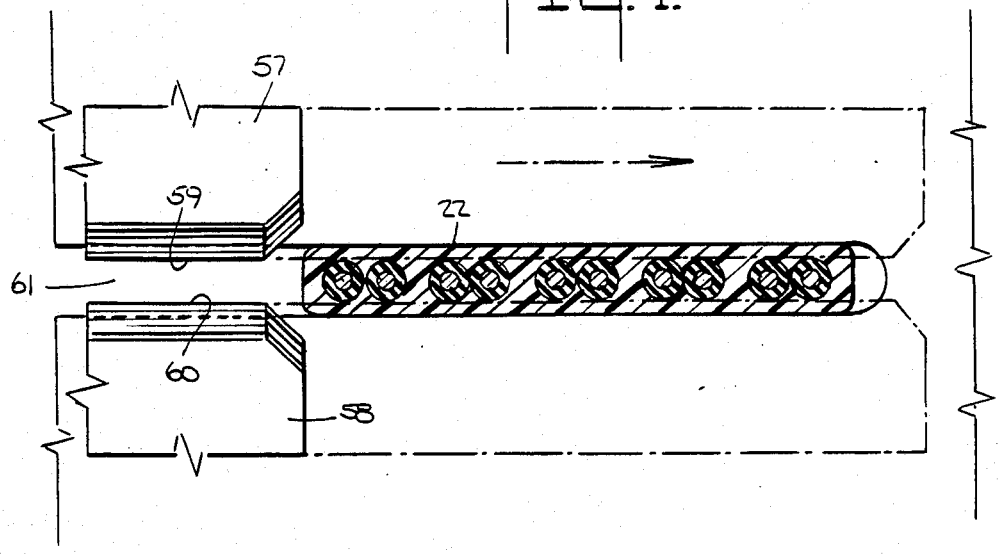
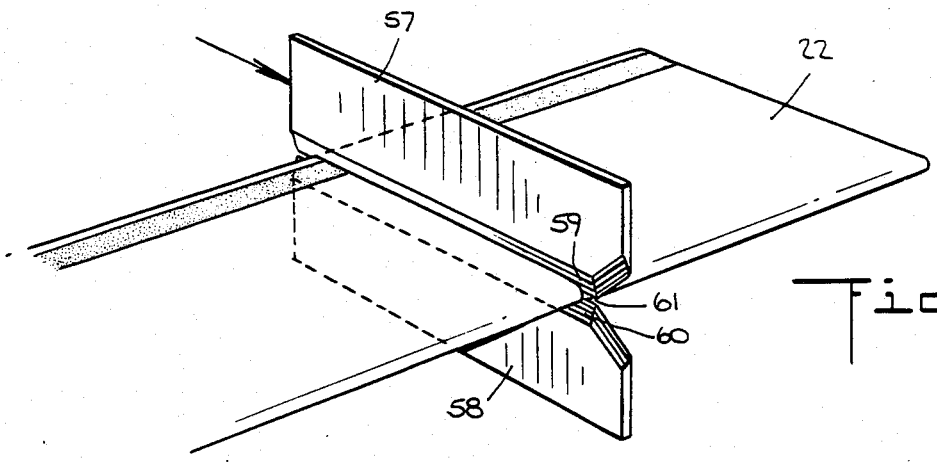
Fig. 5.
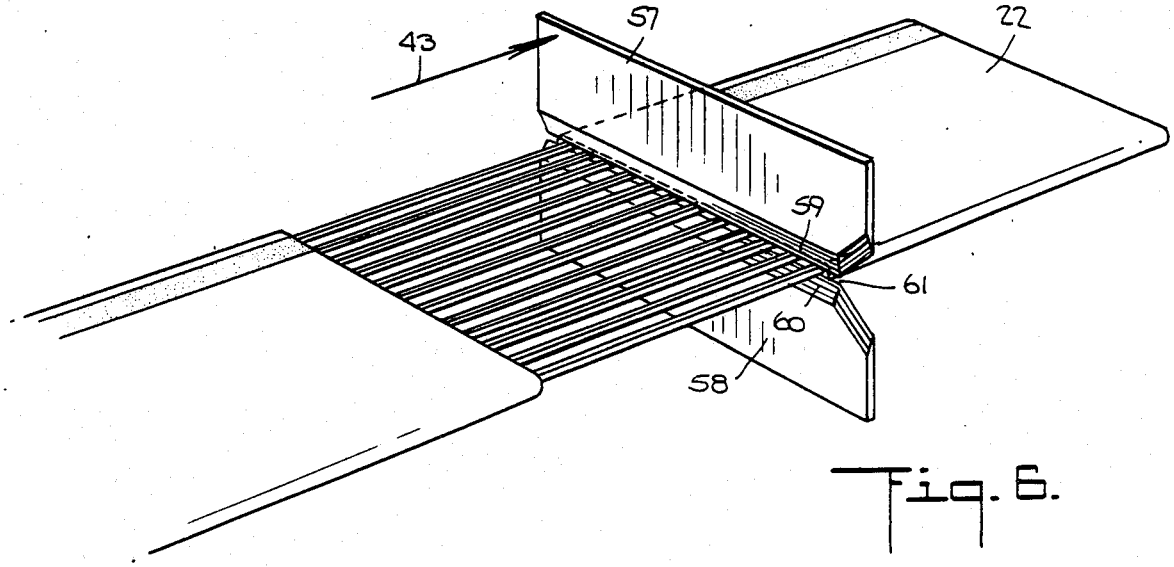
Fig. 6.

10
11
12
13
14
15
16
17
18
19
20
22
23
24
25
26
27
28
30
32
33
36
40
41
42
43
44
45
46
47
48
50
52
53
54
55
63
65
67
68
69
80
83
84
87
96
97
98
99
100
101
102
105
107
108

FLAT MULTIPLE PAIR CABLE STRIPPING AND CONNECTOR ATTACHING APPARATUS

BACKGROUND OF THE INVENTION

The present invention relates to flat multiple pair electric cables and, more particularly, to apparatus for attaching connectors to the ends of such cables.

In U.S. Pat. No. 4,468,089 for "Flat Cable of Assembled Modules and Method of Manufacture", issued Aug. 28, 1984, on an application of William J. Brorein, and assigned to the same assignee as the present invention, there is disclosed a flat communication cable formed of an assembly of standardized modules in edge-to-edge relation surrounded by an overlying polyester protective cover. The modules containing a PVC jacket are united to form a ribbon by a blend of fusion and hot melt adhesive material, and the protective cover is bonded thereto by the adhesive. The modules can contain inter alia polyolefin insulated wire pairs, and the present invention is directed to apparatus for attaching end connectors to cable of that general category. As explained in said patent, the plastic covered or insulated conductors are non-adherently sheathed with a plastic sheathing material to produce the modules. The modules are, in turn, surrounded with a covering layer of plastic material to which they are adherently joined.

Several methods are described in the prior patent art for removing the outer insulating jacket from flat multiconductor cable and these will be mentioned briefly hereinafter, but none is suitable for use with a Brorein cable. For example, in Garbis et al. U.S. Pat. No. 4,394,828, issued July 26, 1983, there is described a cable stripping tool that includes a blade with two cutting edges positioned in a common plane at a 60° angle to each other and arranged to penetrate the cable from the cable end, slipping between the sheathing and the enclosed conductors, and simultaneously slitting the two longitudinal side edges of the cable sheathing. However, this tool assumes an unbonded condition between the jacketed or sheathed conductors and the outer sheathing.

In Toeppen U.S. Pat. No. 4,455,745, issued June 26, 1984, a flat cable is first placed between two cutting blades that can be brought toward each other to produce transverse cuts in the outer cable jacket while side cutters penetrate the side edges thereby producing a cut transversely about the entire periphery of the cable. Then a separate cutter is used to produce a longitudinal cut either between two spaced transverse cuts or between a transverse cut and the end of the cable whereupon the severed portion is peeled away to expose an underlying conductive shield. Again, the cable end preparation apparatus operates on the assumption that the outer jacket is not bonded to the underlying material.

Typical of a different approach to cable end preparation is Shields U.S. Pat. No. 4,439,631, issued Mar. 27, 1984. This patent describes a machine having a cutter for removing side portions of the cable, a grinding wheel for removing an insulating surface coating of the cable, and a scoring blade for scoring the underlying electrical shield that is subsequently broken away. The drawbacks implicit in this patented apparatus, at least for the purpose contemplated herein, will be evident after reading the description of the present invention to follow.

After stripping the outer jacket material from the individually insulated wires the individual wires have to be attached to an end connector. However, the known procedures and apparatus have serious limitations. Representative of the prior art are the devices disclosed in U.S. Pat. Nos. 3,742,571; 4,389,769; 4,453,307; and 4,243,288. The first three patents relate to tools for attaching wires to AMP Incorporated multi-contact connectors wherein the wires are attached one by one as the connector is advanced stepwise through the tool. The fourth patent requires the connector casing to be assembled about a connector core structure with all of the wires preformed to lie in respective parallel array planes for displacement simultaneously into the core structure. However, it will become apparent that such fitting and the wiring technique employed is not suitable for use with the Brorein cable mentioned above.

SUMMARY OF THE INVENTION

With the foregoing as background, it is an object of the present invention to provide apparatus for attaching connectors of the general, type described in U.S. Pat. No. 3,742,571, to flat multiple pair electric cables of the type described in said Brorein patent. More specifically, it is an object to provide apparatus for preparing the ends of such cables for connector attachment, and for effecting such attachment of all conductors simultaneously.

In accordance with the present invention there is provided an apparatus for attaching connectors to the ends of flat multiple pair electric cables where the cables contain a plurality of parallel laterally spaced apart conductor pairs, each pair comprising parallel laterally spaced apart identical gauge conductors, and all of said conductor pairs are disposed between parallel layers of insulating sheathing material; and the connectors are of the type wherein the conductors are received in two parallel arrays with each array containing one of the conductors from each conductor pair and the conductors are attached to the connector by being pressed into corresponding slots in the connector; said apparatus comprising in combination a sheath stripping station and a connector attaching station, said sheath stripping station comprising means for severing an end portion of said sheathing material and longitudinally separating said severed end portion from about said conductors without disturbing the parallel spaced apart relation of said conductors, means operative before complete separation of said sheath end portion for engaging said conductors from opposite sides of the cable to engage on each side of said cable one conductor of each pair of conductors, said last mentioned means including means operative upon complete removal of said sheath end portion to separate said conductors that are no longer confined within sheathing material into two planar arrays diverging in opposite directions from the general plane of said cable; and said attaching station comprising means for holding a connector and guiding the conductors within each of said planar arrays toward one another and toward corresponding channels in said connector, and means for severing excess conductor ends from the main body of said conductors and thereafter urging the remaining ends of said unsheathed conductors into said connector slots.

BRIEF DESCRIPTION OF THE DRAWINGS

The invention will be better understood after reading the following detailed description of the presently preferred embodiment thereof with reference to the appended drawings in which:

FIG. 4 is an enlarged fragmentary view showing a cable in position preparatory to severance of the sheath by a pair of knives;

FIG. 5 illustrates diagrammatically the relationship between knife edges and cable at the completion of the sheath severing step;

FIG. 6 illustrates diagramatically in perspective the stripping operation;

Figure 1:
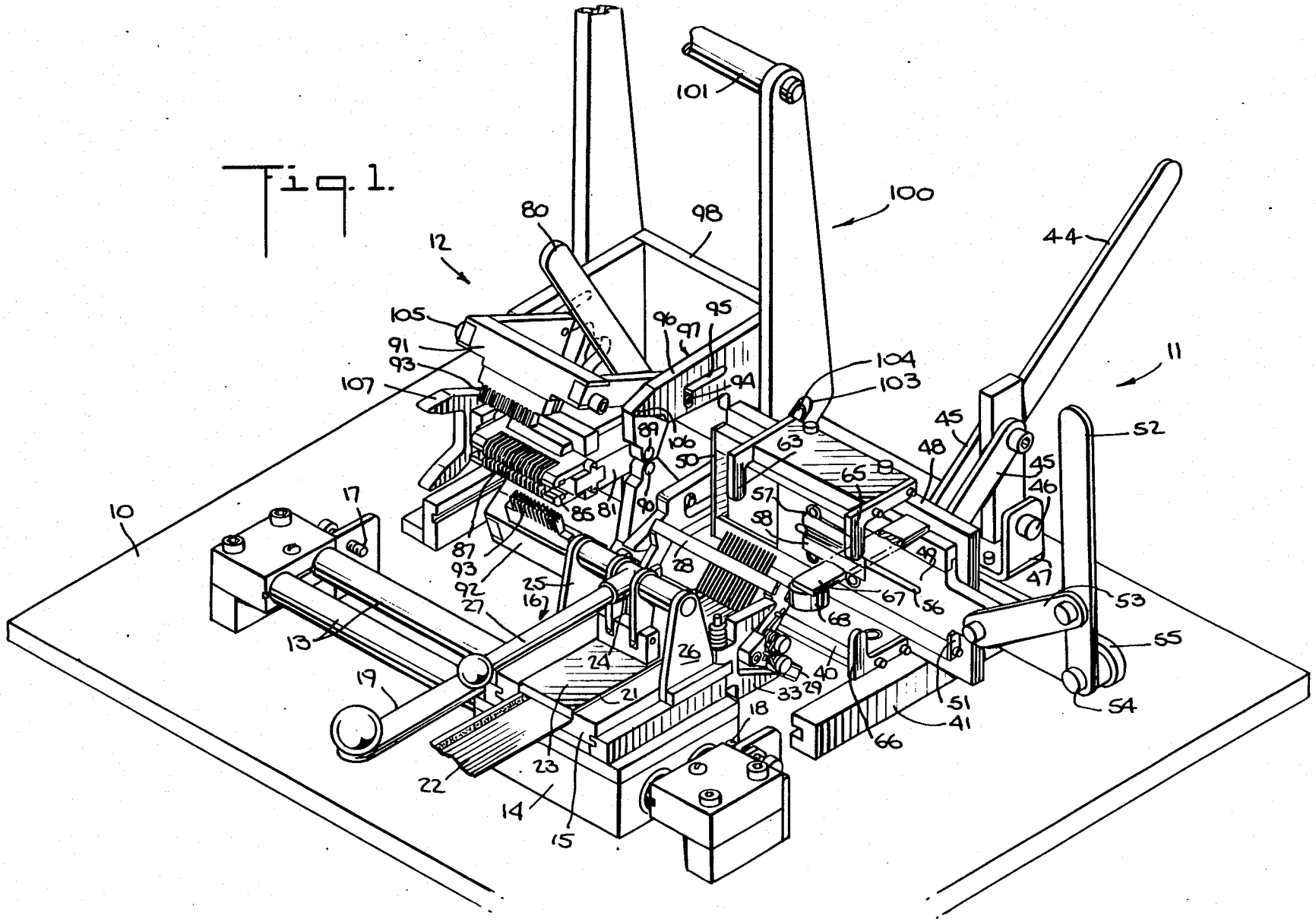
FIG. 1 is a perspective view of the assembly apparatus embodying the present invention with the sheath stripping station in the foreground and the connector attaching station in the background.

Referring to the drawings, the apparatus consists of a metal base plate 10 on which are mounted the sheath stripping tool designated generally by the numeral 11, at the sheath stripping station, and the connector attaching tool designated generally by the numeral 12, at the connector attaching station. The tools 11 and 12 are mounted side-by-side on plate 10. In front of both tools 11 and 12 there is mounted a set of rails 13 supporting a carriage 14 bearing a cross slide 15 that, in turn, carries cable clamping mechanism 16.

Figure 17:
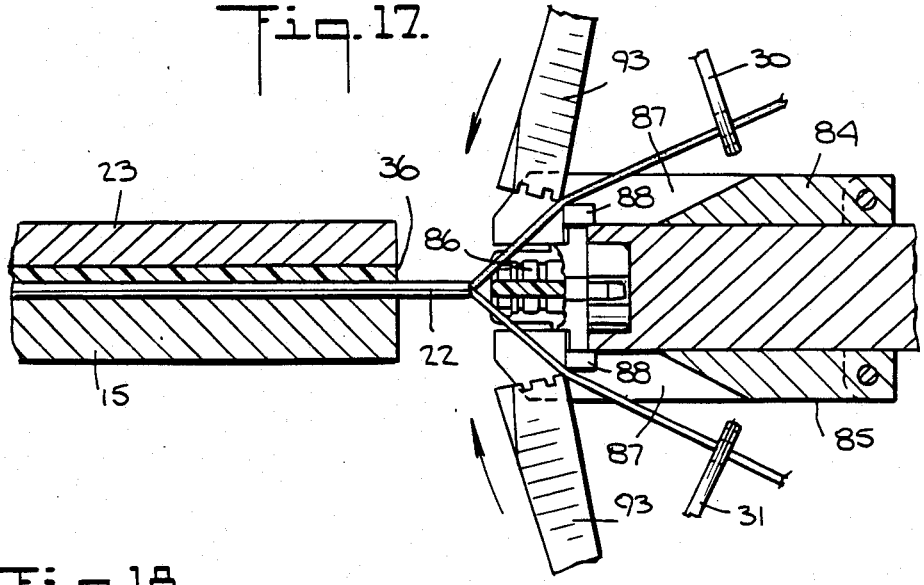
FIGS. 17 to 19 are fragmentary sectional views taken along the line 17—17 in FIG. 16, and showing successive phases in the attachment of the connector.
Figure 18:
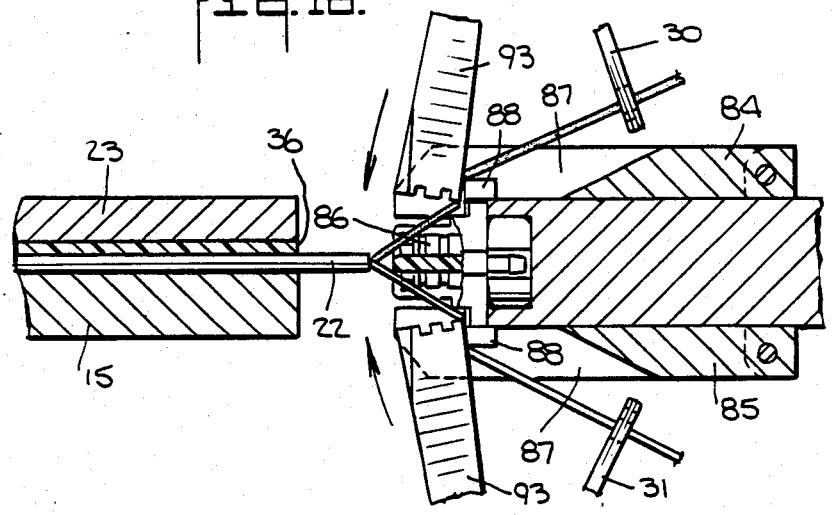
Figure 19:
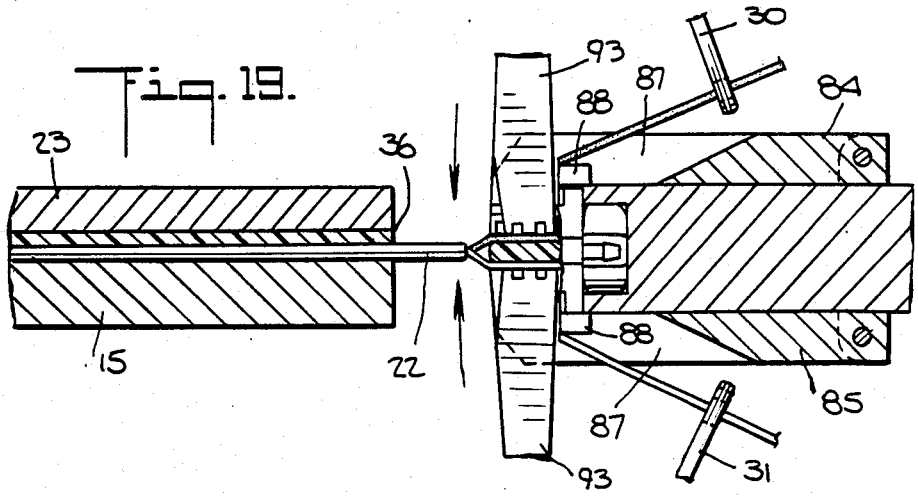
Figure 20:
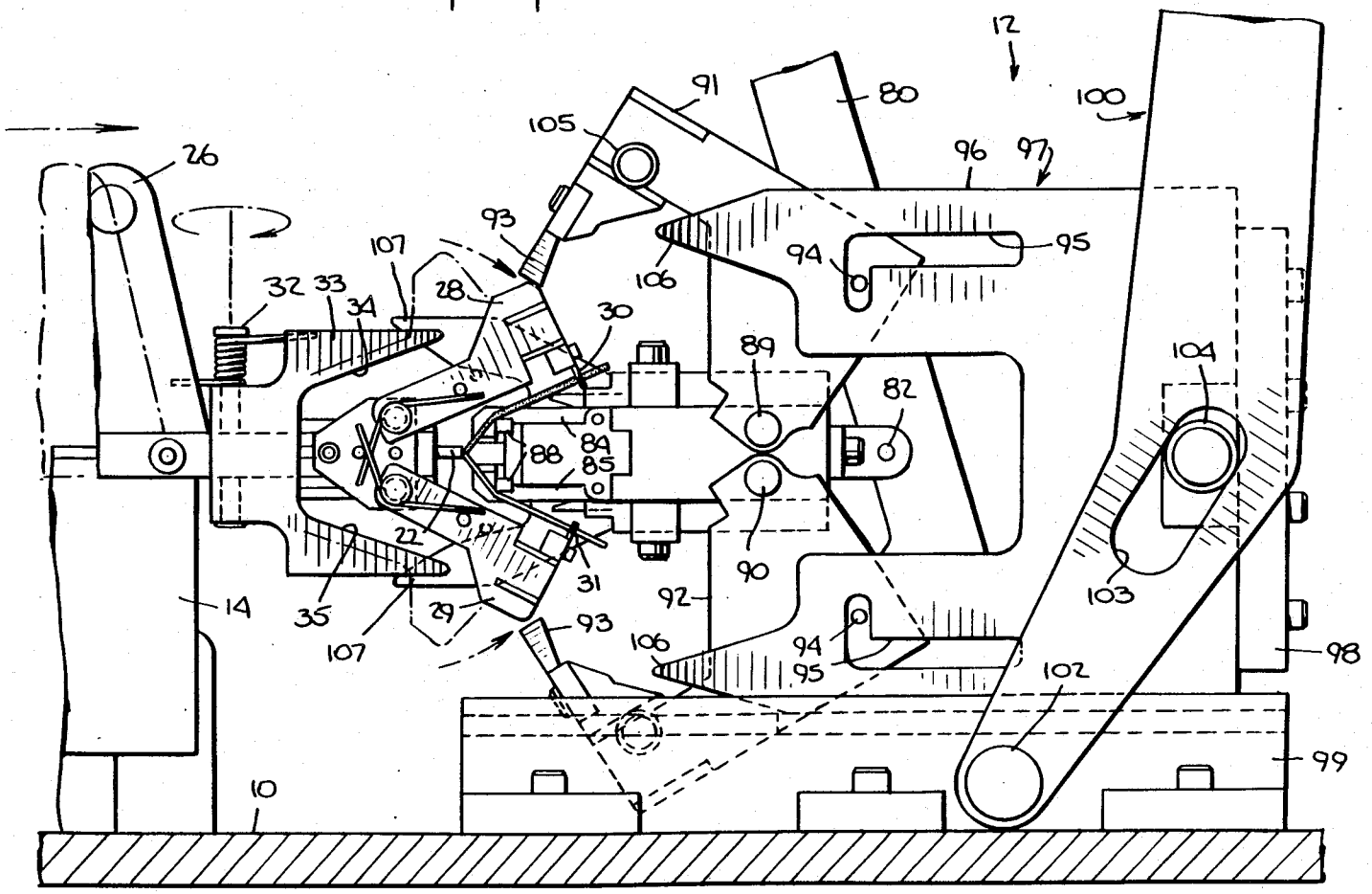
FIGS. 20 to 22 are views similar to FIG. 15 but showing the apparatus in successive operating positions encountered during connector assembly.

Carriage 14 is free to move along rails 13 between left and right end stops 17 and 18, respectively, which stops are adjustable to locate carriage 14 in proper registration in front of either the connector attaching tool 12 on the left or the sheath stripping tool 11 on the right. A lever 19 is pivotally mounted on carriage 14 and connected by a link 20 to cross slide 15 for moving the cross slide toward and away from the tools 11 and 12. The top of the cross slide 15 has a shallow channel 21 dimensioned to receive the flat multiple pair electric cable 22 when pressure plate 23 is raised through manipulation of a bell crank 24, journalled in brackets 25 and 26, under control of a lever 27. The pressure plate 23 is faced on its underside with an elastomeric pad 36 (see FIG. 17) for ensuring a friction grip on a cable in channel 21. In addition, the plate 23 is pivotally connected to the end of the clevis-type arm of the bell crank 24 to render plate 23 self-leveling as it is pressed down upon a section of cable.

Figure 7:
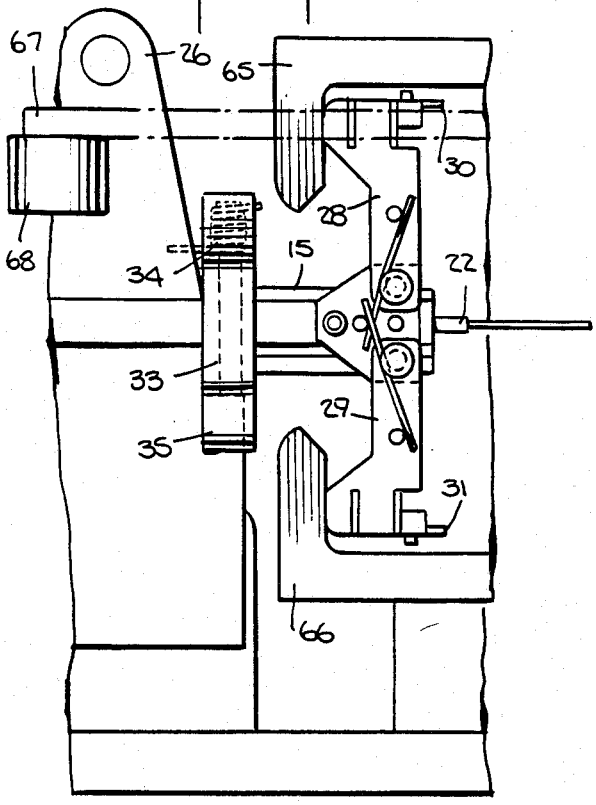
FIGS. 7 to 10 are fragmentary side elevational views of portions of the sheath clamping and severing stations during different phases in the operation thereof.
Figure 9:
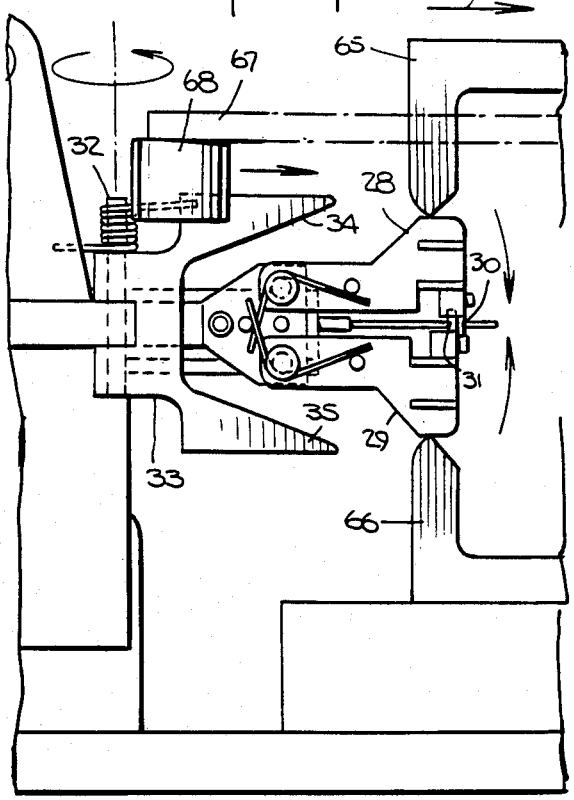
Figure 8:
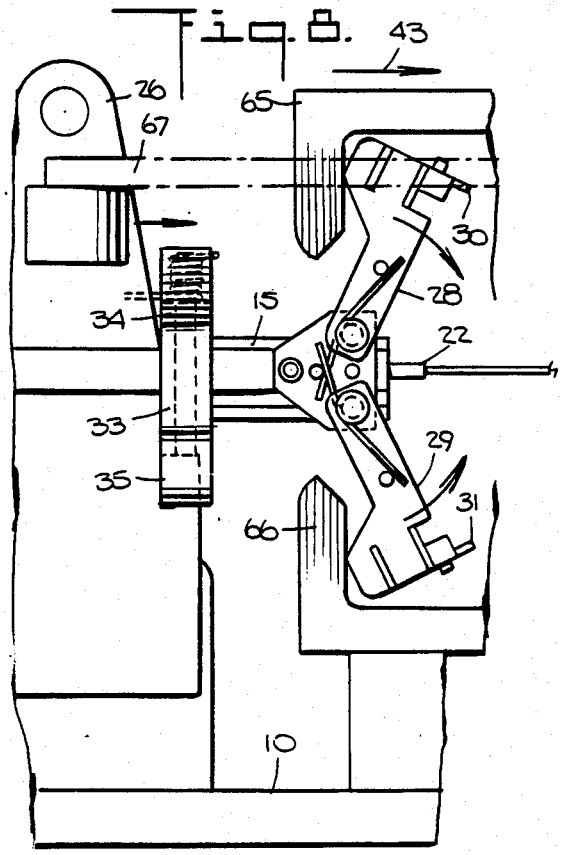

A pair of U-shape frames 28 and 29 are pivotally mounted at that end of the cross slide 15 that faces the tools 11 and 12. The frames 28 and 29 are spring biased as shown in FIG. 7 to assume, when unrestrained, an open or spread apart condition. Each frame, 28 and 29, carries a specially configured comb element or blade 30 and 31, respectively, the details of which will be further explained below. The frame 29 has slightly shorter side arms than the arms of frame 28 such that when the frames 28 and 29 are urged to a horizontal position into essentially parallel relationship, the combs 30 and 31 will assume a close overlapping relationship as best seen in FIG. 9.

Figure 10:
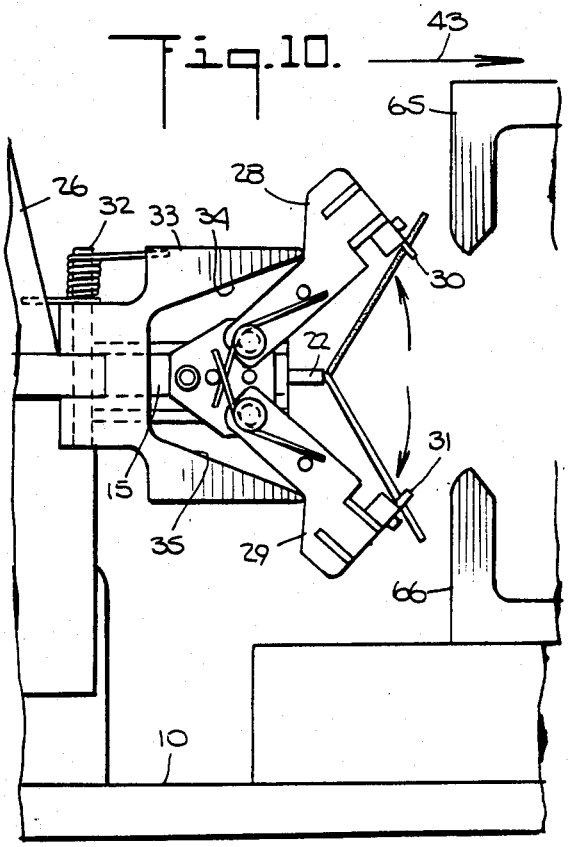
Figure 12:
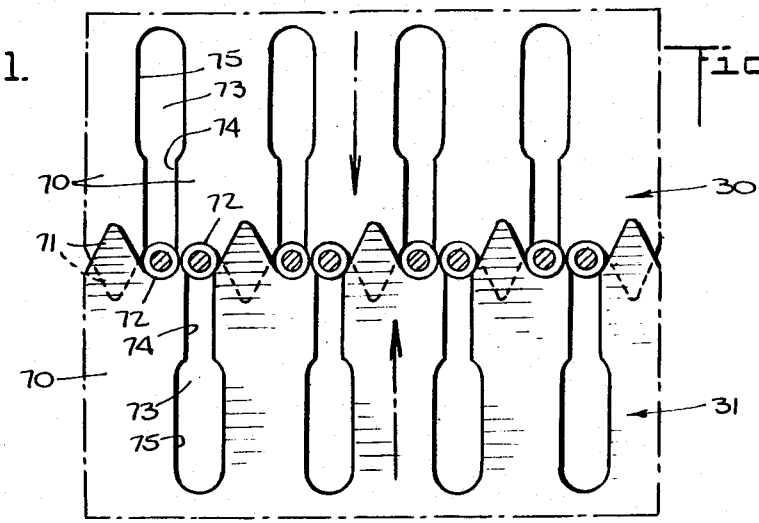
FIGS. 11 to 14 are fragmentary views of the comb members that engage individual conductors of a pair and operate to separate said conductors into two splayed apart arrays.
Figure 14:
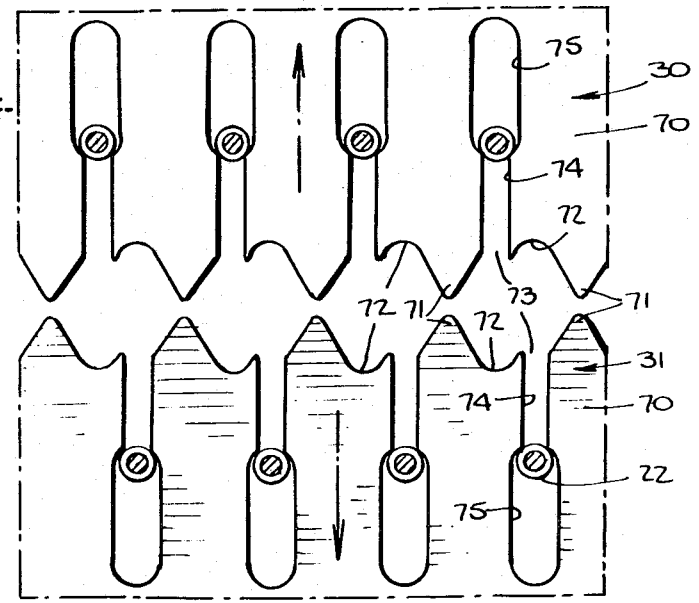
Figure 11:
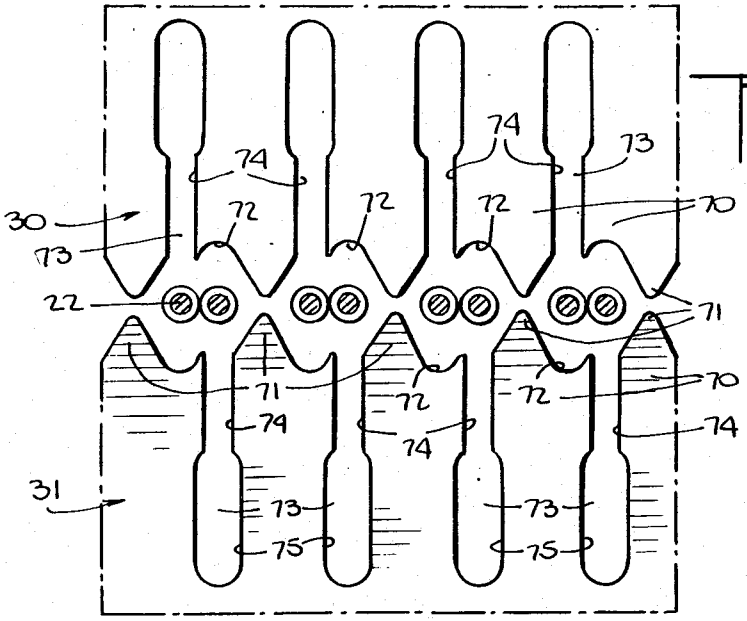
Figure 13:
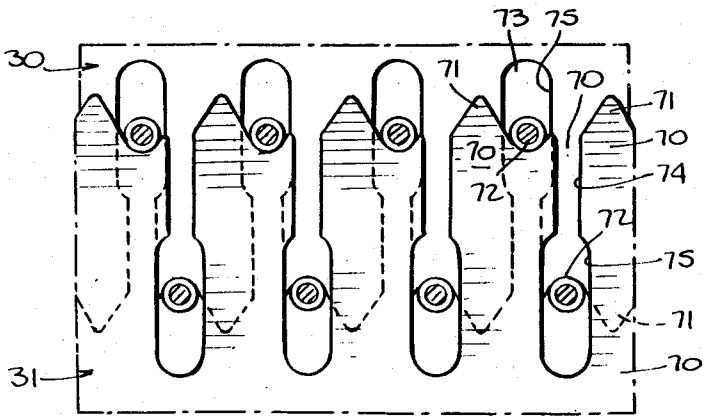
Figures 15, 23:
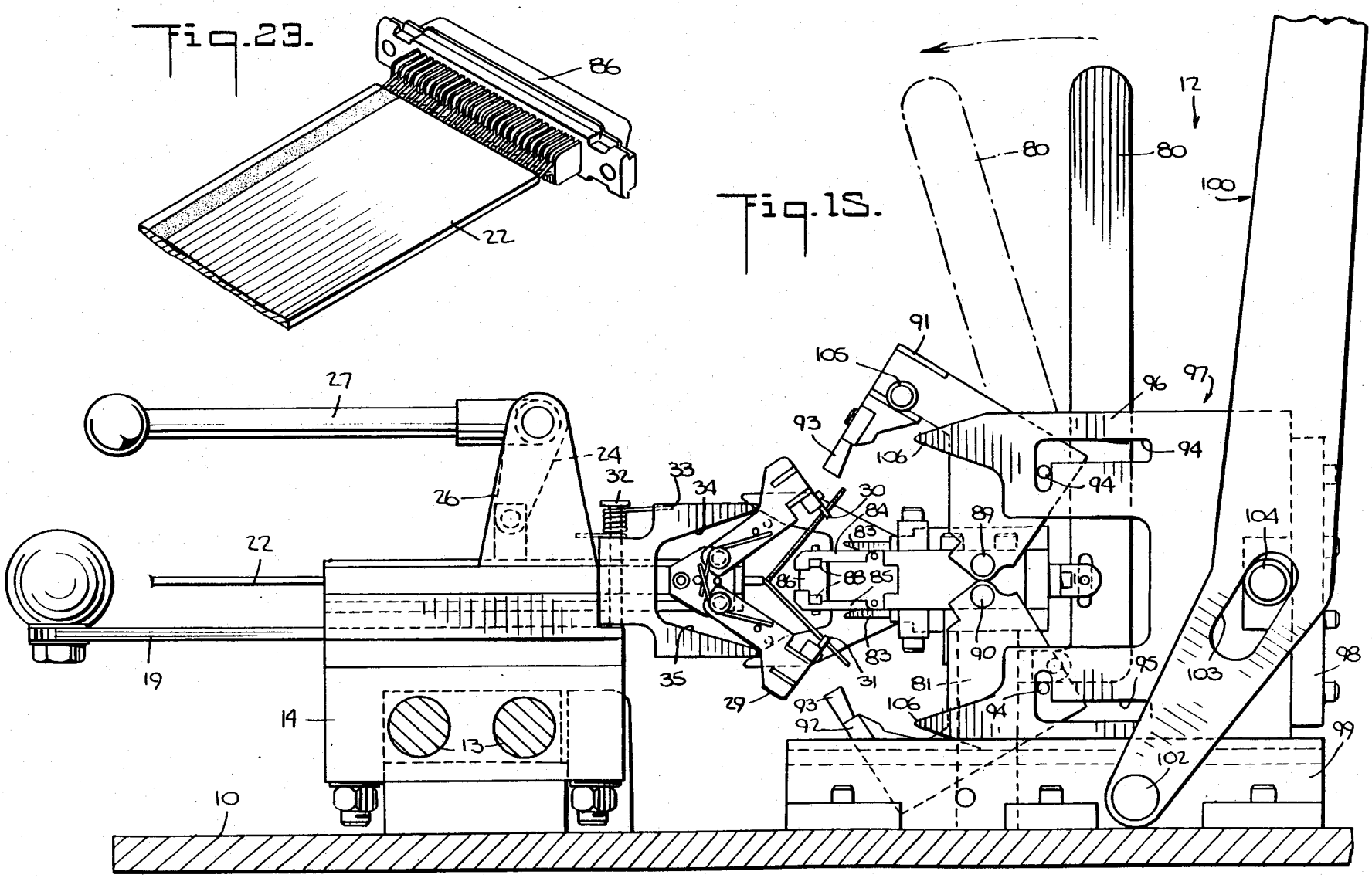
FIG. 15 is a sectional view of the right side of the connector attaching station taken along line 15—15 in FIG. 2 and showing the splayed cable in position before a connector.
FIG. 23 is a perspective view of the completed cable-to-connector assembly.
Figure 16:
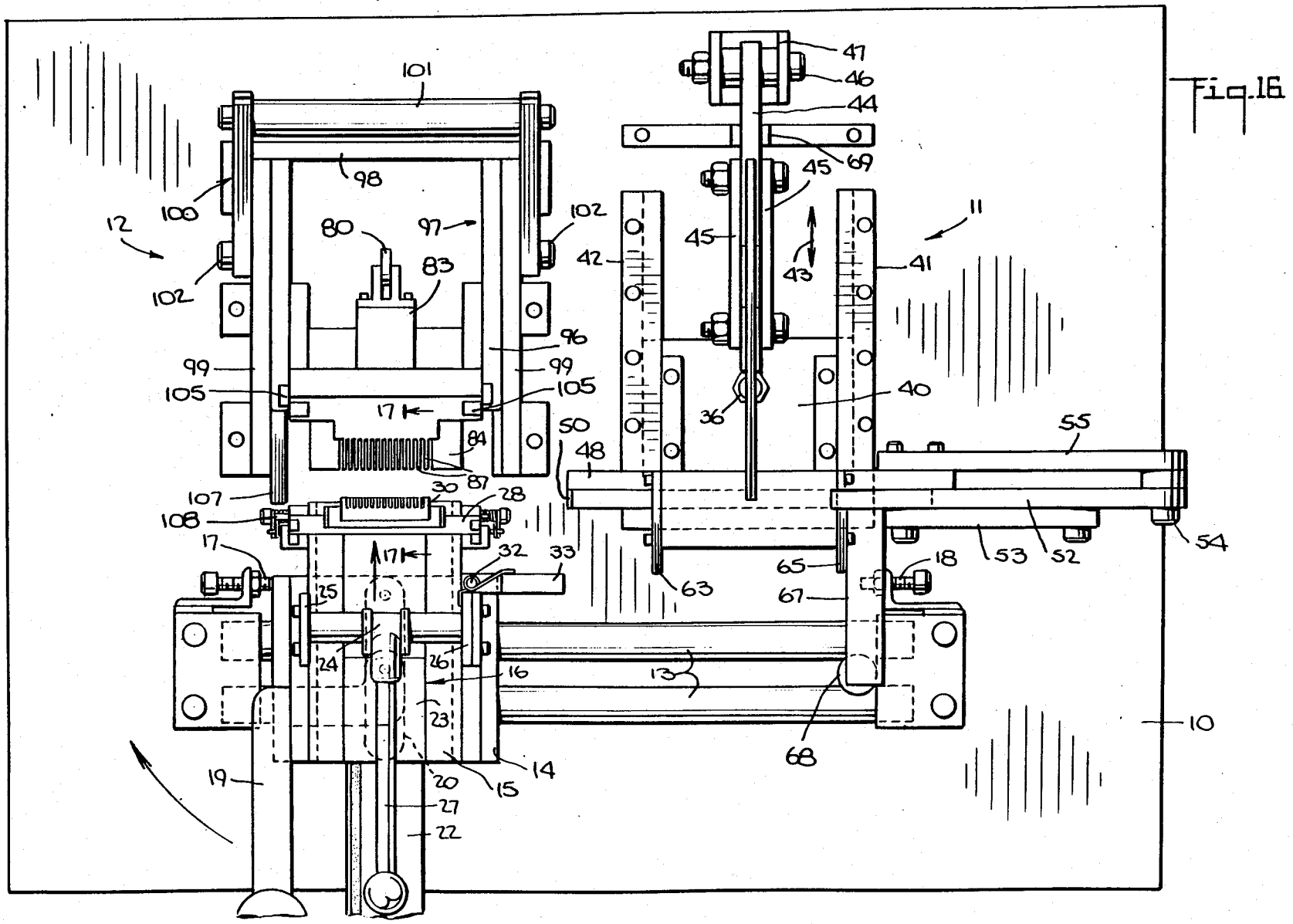
FIG. 16 is a top plan view of the apparatus of FIG. 1.

Also mounted on the cross slide 15 on a pivot 32 is a U-shape member 33 spring biased to a position parallel to rails 13 as shown in FIG. 16. The member 33 has diverging confronting surfaces 34 and 35 that, when member 33 is urged against its biasing spring to a position normal to rails 13, will engage frames 28 and 29 when the latter are partially deflected into a "half-closed" condition as shown in FIGS. 10 and 15. So long as member 33 occupies the position permitting engagement with frames 28 and 29, member 33 will prevent the frames 28 and 29 from opening fully. This cooperation will be explained further below.

At this point, it will be convenient to consider the construction of the sheath stripping tool 11. It includes a carriage 40 mounted on side rails 41 and 42 for movement back and forth in the direction of the arrows 43 under control of the knee action linkage consisting of lever 44 and links 45, the former being pivotally mounted at 46 in a clevis 47 bolted to base plate 10.

Mounted vertically on carriage 40 at right angles to the direction of carriage travel is a back plate 48 to which is secured a cross slide 49, the latter being movable between stops 50 and 51 under control of another knee action linkage consisting of lever 52 and link 53. The lever 52 is pivotally mounted at 54 at the end of an arm 55 extending from the back plate 48. The cross slide 49 has a horizontal slot 56 whose vertical or width dimension is slightly larger than the thickness of the cable to be terminated. The length of slot 56 is a little more than twice the width of the flat cable, i.e., cable 22. Adjustably mounted on cross slide 49 are the pair of spaced apart knife members 57 and 58, each with a knife edge 59 and 60, respectively, confronting the knife edge of the other with a gap 61 between edges 59 and 60 substantially equal to the outside diameter of the individually insulated conductors of the cable 22. The knife members or blades 57 and 58 are mounted on the side of slot 56 that is remote from the lever 52. When slide 49 is against the left stop 50, the right half of slot 56 will be in registration with a slot 62 in back plate 48. Slot 62 has an entry with a relatively wide mouth vertically that tapers rearwardly to a narrow slit slightly larger than the cable 22 so that the end of the cable passing through slot 56 will enter slot 62 and be piloted through the narrow slit to a fixed stop 36 at the rear of back plate 48.

Figure 2:
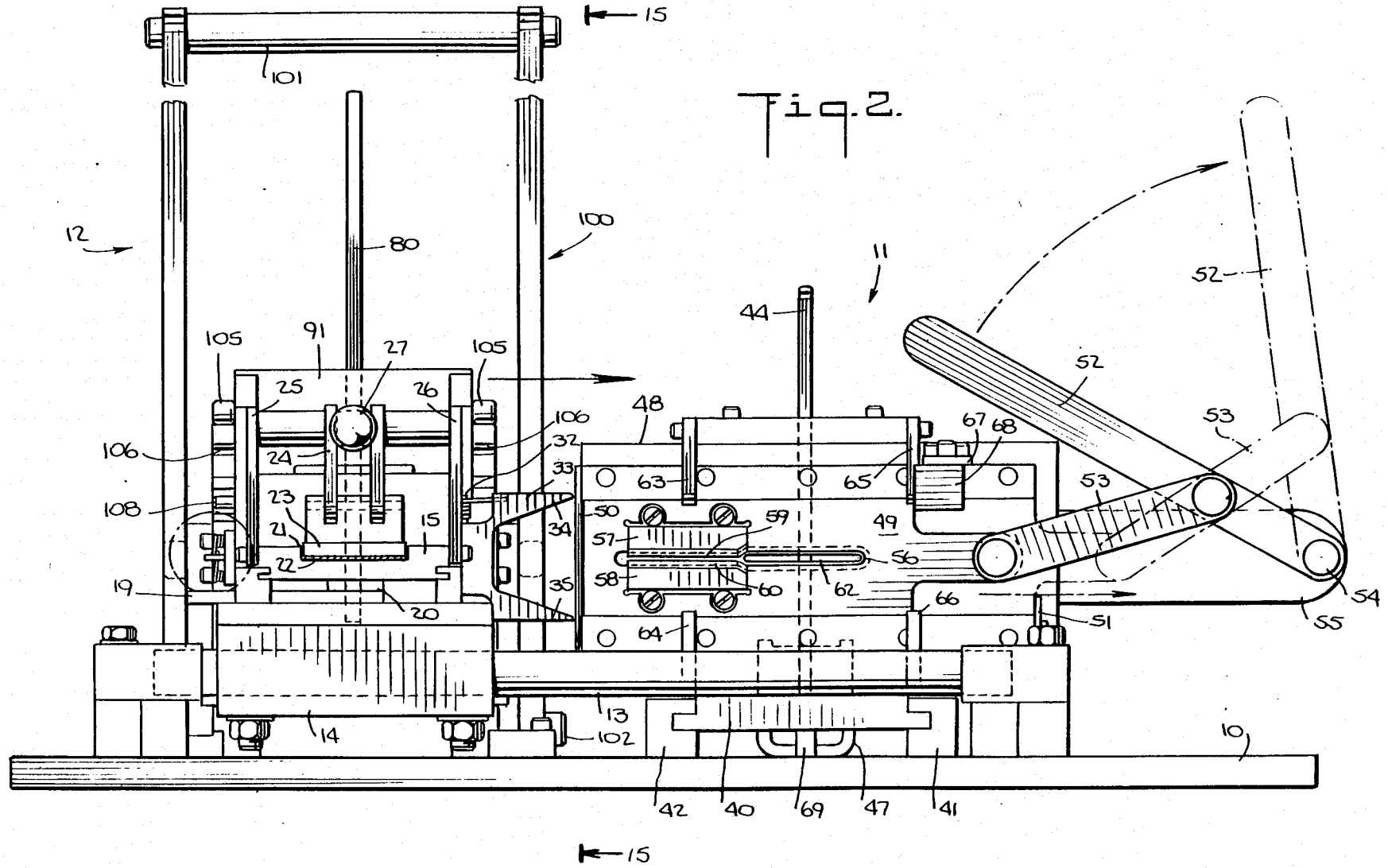
FIG. 2 is a front elevational view of the apparatus of FIG. 1 with the cable clamping carriage in front of the connector attaching station at the end of an assembling sequence and showing the motion of the cable sheath severing linkage.

As seen in FIGS. 1 and 2, a group of four cam arms 63, 64, 65 and 66 are mounted on back plate 48 projecting foward over slide 49. The arms 63 to 66 are L-shape with the vertical portions spaced a predetermined distance in front of slide 49. The criteria for such spacing will be apparent from the discussion below.

Also carried by back plate 48 is an arm 67 that extends out in front of slide 49 and carries at its outer end a cam 68 that is mounted eccentrically to afford adjustment therefor.

Figure 3:
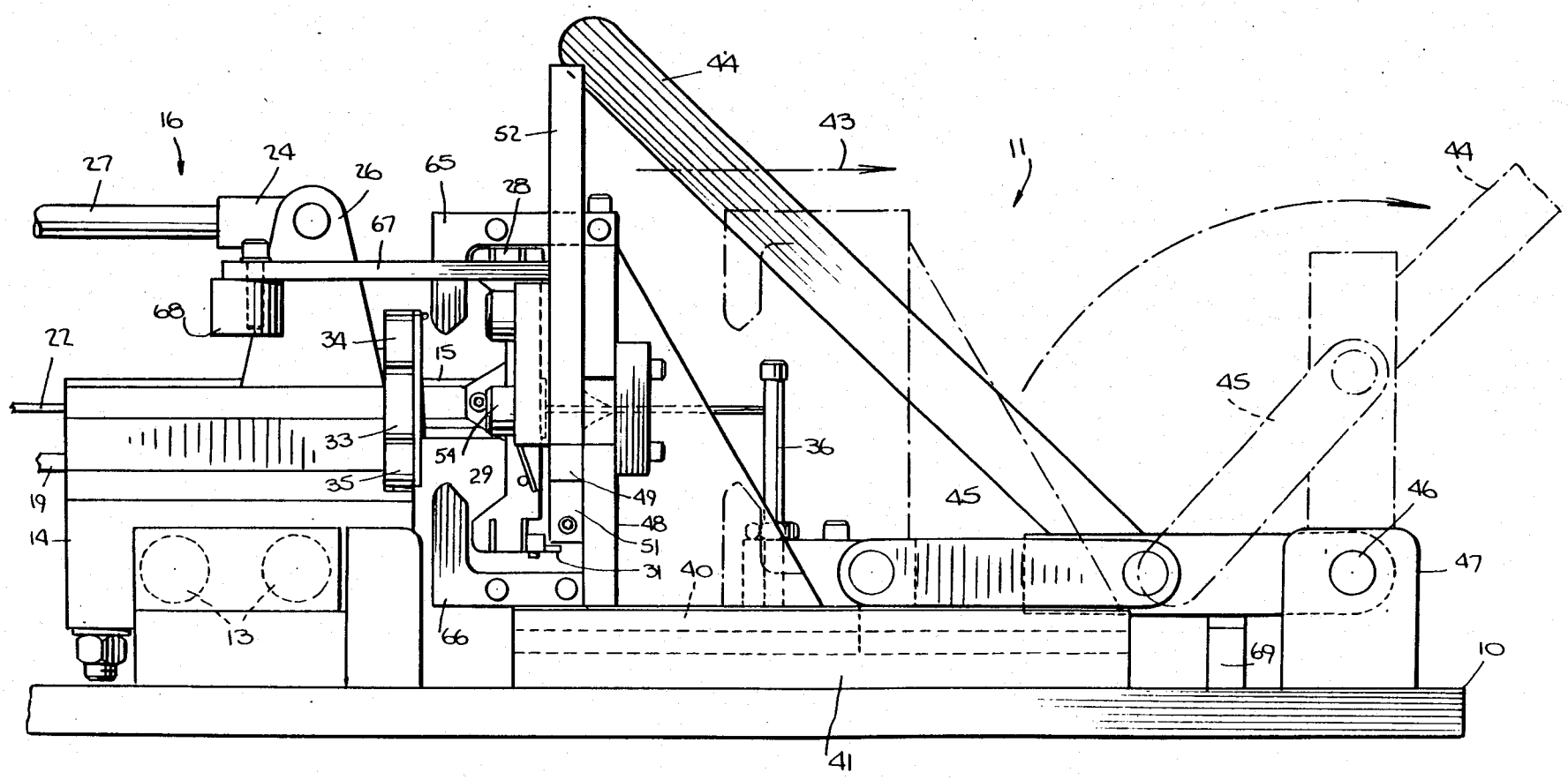
FIG. 3 is an elevational view of the right side of the apparatus of FIG. 1 showing the relationship of parts as the cable clamping carriage is brought into confrontation with the sheath stripping station and showing the motion of the sheath stripping linkage.

Before proceeding with a description of tool 12, it will be helpful to have an understanding of the operation of the apparatus that has been described so far. At the completion of a connector attachment sequence, the carriage 14 will be against stop 17 with cross slide 15 retracted. Carriage 40 will also be in a retracted position engaging a stop 69, while cross slide 49 is in its far right position. To commence an attachment sequence, the slide 49 must be repositioned to the left against stop 50 by means of lever 52. Carriage 40 should be brought forward by manipulating lever 44 forward as far as it will go to the position shown in solid lines in FIG. 3. Then, using lever 19, the carriage 14 should be moved toward and against stop 18. This will position the frames 28 and 29 between cross slide 49 and the vertical portions of cam arms 63 to 66. Member 33, the intermediate position locking member for frames 28 and 29, will be positioned between cam 68 and cam 65.

Next, pressure plate 23 is raised by lifting lever 27 and the end of a length of cable is placed in channel 21 and advanced through slot 56 and slot 62 to stop 36 whereupon the cable is clamped by lowering lever 27 and pressure plate 23. Applying downward pressure to lever 27 with slight pressure toward the right to maintain a grip on the cable and hold carriage 14 against stop 18, lever 52 should be urged toward the right as shown in FIG. 2, drawing knife members (blades) 57 and 58 carried by cross slide 49 across the cable, a predetermined distance from the cable end. Slide 49 should be drawn all the way across until stop 51 is engaged. This will locate blades 57 and 58 stradling the cable centered thereon, and with the sheath penetrated and severed. The action is clearly illustrated in FIGS. 4 and 5.

Now, maintaining a secure grip on the cable by downward pressure on lever 27, lever 44 (see FIG. 3) should be urged to the rear drawing carriage 40 with it. Knife members 57 and 58, because gap 61 is less than the thickness dimension of the cable, will pull the severed portion of the sheath away from the main body of the cable in the longitudinal direction as illustrated in FIG. 6 exposing the individually insulated conductor pairs. As the rearward travel of carriage 40 progresses, cams 63 to 66, following the sequence shown in FIGS. 7 to 10, will first engage the backs of frames 28 and 29 urging them toward the horizontal, bringing combs 30 and 31 toward the exposed conductor pairs. The ensuing sequence of operation will be seen from the drawings. Before blades 57 and 58, operating as a sheath stripper (FIG. 6), have completely removed the severed sheath portion, and while the pull on the severed sheath portion maintains the insulated conductor pairs under tension and taut, the combs 30 and 31 will be brought together into overlapping relationship as shown in FIG. 9.

Referring to FIGS. 11 to 14, it will be seen that the comb-like members 30 and 31 have tines 70 having ends with a special profile or contour consisting of a triangularly pointed projection 71 alongside a semi-circular notch 72. The projections 71 are dimensioned to enter the inter-pair space between respective conductor pairs while the notches 72 are dimensioned to engage each a different one of the insulated conductors of a pair. One comb engages all of the conductors on the right within a pair while the other comb similarly engages all the conductors on the left. Thus, as the members 30 and 31 are brought together they engage the conductors separating one conductor from each pair and urging it into the inter-tine slot 73 on the opposite comb-like member. Viewing the slots 73 it will be seen that each has an entrance section 74 with parallel walls spaced apart a distance less than the outside diameter of one of the insulated conductors of a pair but spaced sufficiently to permit such conductor to be pressed therebetween through said entrance section. Beyond the entrance section 74 is a retention section 75 representing a continuation of the entrance section 74 but having parallel walls spaced apart a distance greater than the outside diameter of one of said insulated conductors. The slots on comb 30 are interlaced relative to the slots on comb 31 such that a tine 70 on one comb overlaps a slot 73 on the other comb while the contoured edges of the tines 70 are shaped to separate adjacent conductors in the cable.

At an intermediate point in the rearward movement of carriage 40, the frame members 28 and 29 will have been brought completely together and the comb members 30 and 31 will each have engaged one half of the complement of insulated conductors (FIG. 9). At this point, cam 68 will have advanced past pivot point 32 of lock member 33 urging the latter to rotate about its pivot into the plane of the side arms of frames 28 and 29. While the presence of cam 68 holds member 33 in this position the continued movement of carriage 40 will strip the severed sheath portion from about the insulated conductor pairs whereupon cams 63 to 66 will move beyond frames 28 and 29 releasing the latter. Under urging of their respective return springs the frames 28 and 29 will spring apart until they engage the arms of member 33 (see FIG. 10). The combs 30 and 31 will pull the insulated conductors into two planar arrays, best seen in FIG. 10, diverging in opposite directions from the general plane of the cable 22. Friction between arms 28 and 29 and the member 33 will hold member 33 in locking position until the frames 28 and 29 are disturbed during a subsequent operation. This essentially completes the cable stripping operation.

Operation now transfers to the connector attaching station and to attaching tool 12. Before moving carriage 14 to the attaching station, a lever 80, pivotally joined to the rear of an inverted L-shape standard 81, and pinned at 82 to a U-shape element 83, is moved rearwardly to retract element 83, exposing the spring biased fanning plates 84 and 85. The fanning plates 84 and 85 are pivotally mounted at the upper end of standard 81, spring biased to open diverging positions unless restrained in closed horizontal position by overlying arms of the element 83. The fanning plates 84 and 85 are shaped to grasp, when closed, a cable connector 86, and are slotted at 87 to receive individual conductors for positioning in registration with slots in the connector 86. A trimming blade 88 is carried by each fanning plate.

Also pivotally joined, at 89 and 90, to standard 81 are respective frame members 91 and 92 for carrying assemblies 93 of trimmer-inserter blades. Each frame member 91 and 92 has a laterally projecting pin 94 at each side that rides in an L-shape cam slot 95 in a leg 96 of a U-shape cam structure 97. There is a cam structure 97 on each side of the standard 81 that is joined by a connecting plate 98 to provide a yoke type structure movable as a slide back and forth on side rails 99 that are secured to base plate 10.

A double arm lever assembly 100 having a handle 101 is pivoted at 102 to the corresponding rail 99. A slot 103 in each lever arm of the assembly 100 cooperates with a corresponding roller cam follower 104 mounted on cam structure 97 such that manipulation of lever 100 operates to slide the structure 97 back and forth. FIG. 15 illustrates the lever 100 and cam structure 97 in the retracted or rearward position. Slots 95 acting on pins 94 hold the frames 91 and 92 in an open jaw position. Notice should be taken of the rollers 105 mounted on the sides of frames 91 and 92 and the tapered or triangular shaped ends 106 of the legs 96. The cooperation between these parts will be described later.

On the left side of the tool 12 is one other part that requires mention. It is a V-shape element 107 projecting forward in front of fanning plates 84 and 85. The function of element 107 will be described below.

Having completed the cable stripping operation, lever 80 is moved to the rear, retracting member 83 and opening fanning plates 84 and 85. A connector 86 is placed in position, the shape of the connector and that of the inner surfaces of the fanning plates are such as to permit closure of the fanning plates 84 and 85 only if the connector is correctly oriented so that a given numbered pin or socket always occupies the same position and will always have the same positioned conductor connected to it. To provide this insurance, the cable bears suitable indicia, e.g., a colored stripe along one side, so that the cable will have a reference orientation. This ensures proper location of the connections on opposite ends of a cable.

With the connector in position, lever 80 is brought forward to close the fanning plates 84 and 85 and securely grasp the connector. The lever 100 should be in its rearward position with frames 91 and 92 pulled open. Now, carriage 14, with cross slide 15 retracted, is moved with the clamped stripped cable length to the left against stop 17. The combs 30 and 31 maintain the diverging arrays of the conductor ends (see FIG. 15).

Figure 21:
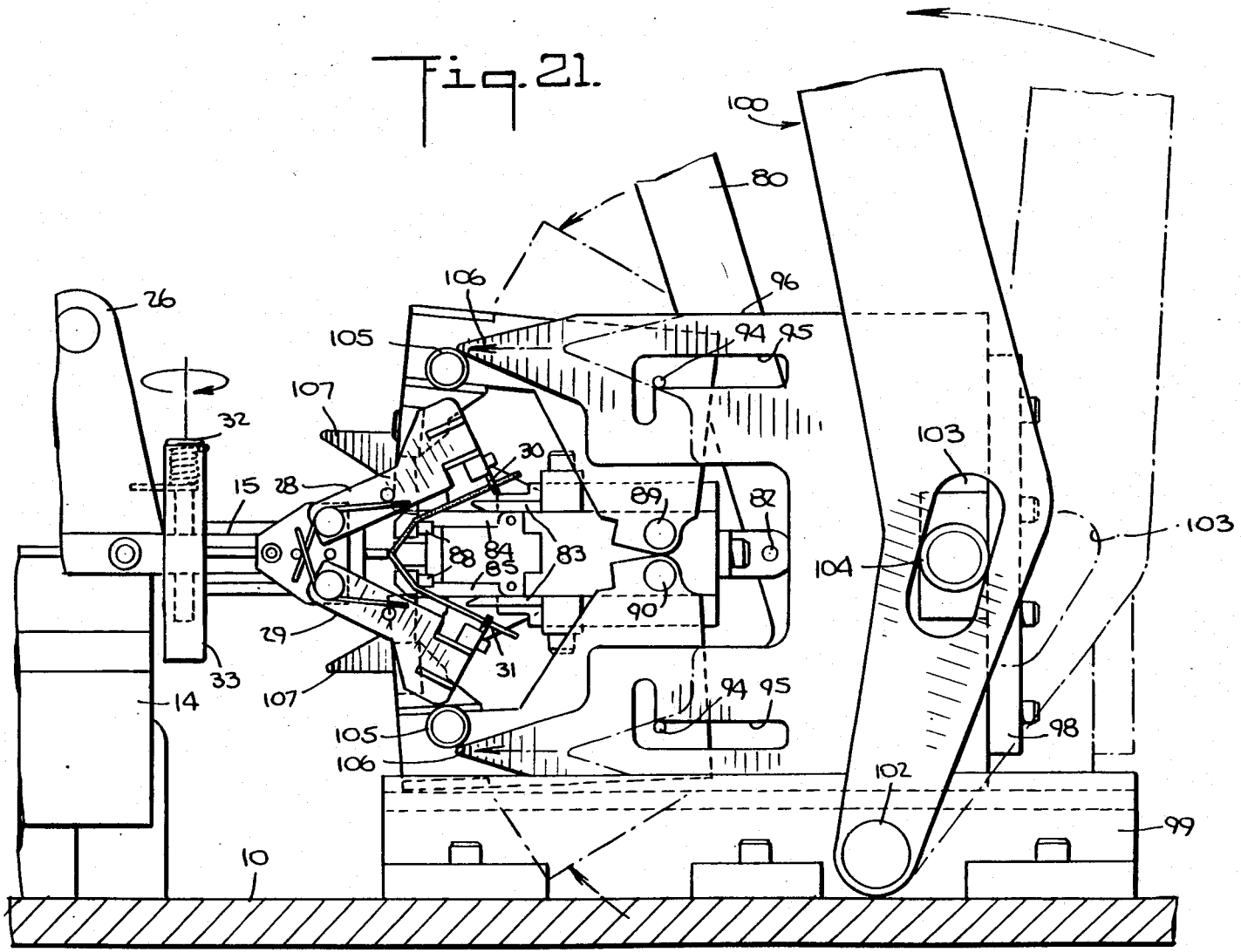
Figure 22:
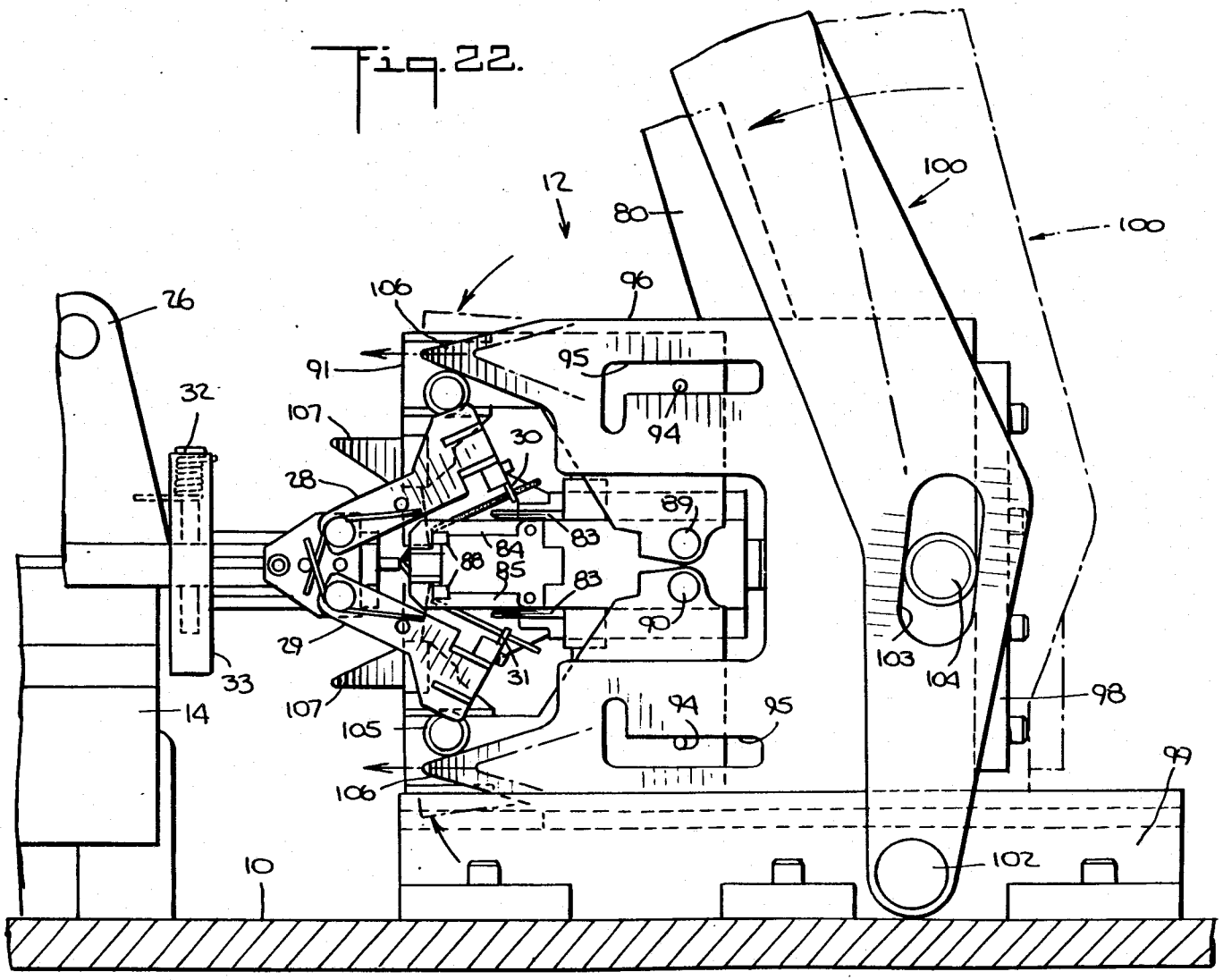

Next, while maintaining pressure on lever 27 to hold clamping pressure on the cable, lever 19 is manipulated to advance cross slide 15. If stop 17 is correctly adjusted, the diverging conductor arrays will advance in registration with the slots 87 in the fanning plates, will enter corresponding slots 87, and rollers 108 on the left sides of frames 28 and 29 will engage, respectively, the inclined surfaces within element 107. As soon as such engagement urges frames 28 and 29 toward each other, lock element 33 will be released and will be spring returned to the position shown in FIGS. 2 and 21. However, the member 107 now prevents frames 28 and 29 from springing apart. Instead, they are brought closer together to lay the individual conductors down in the slots 87 into position adjacent the respective cutting bars 88.

Now, grasping handle 101, the lever 100 is pulled forward first causing rapid closure of frames 91 and 92 until pins 94 ride out of the vertical portions of slots 95. At this point the rollers 105 will be in position to be overridden by the points 106 on the members 97 which points function as cams to forcefully complete the closure of frames 91 and 92. As a consequence, the blades 93 bear against individual corresponding conductors first cutting the excess end length against bar 88 and thereafter urging the remaining conductor end into the corresponding insulation penetrating self-connecting connector slots. Thus, in one motion all conductors are trimmed and attached to the connector.

When attachment is completed, the lever 100 is returned to the rear, opening frames 91 and 92. Then lever 80 is moved to the rear opening fanning plates 84 and 85, releasing the connector that is now attached to the cable. Finally, cross slide 15 is retracted by lever 19 releasing the frames 28 and 29 that spring apart. Lever 27 is elevated releasing the terminated cable.

Having described the invention with reference to the presently preferred embodiment thereof, it should be apparent that various changes in construction can be incorporated without departing from the true spirit of the invention as defined in the appended claims.

What is claimed is:

1. Apparatus for attaching connectors to the ends of flat multiple pair electric cables where the cables contain a plurality of parallel laterally spaced apart conductor pairs, each pair comprising parallel laterally spaced apart identical gauge conductors, and all of said conductor pairs are disposed between parallel layers of insulating sheathing material; and the connectors are of the type wherein the conductors are received in two parallel arrays with each array containing one of the conductors from each conductor pair and the conductors are attached to the connector by being pressed into corresponding slots in the connector; said apparatus comprising in combination a sheath stripping station and a connector attaching station, said sheath stripping station comprising means for severing an end portion of said sheathing material and longitudinally separating said severed end portion from about said conductors without disturbing the parallel spaced apart relation of said conductors, means operative before complete separation of said sheath end portion for engaging said conductors from opposite sides of the cable to engage on each side of said cable one conductor of each pair of conductors, said last mentioned means including means operative upon complete removal of said sheath end portion to separate said conductors that are no longer confined within sheathing material into two planar arrays diverging in opposite directions from the general plane of said cable; and said attaching station comprising means for holding a connector and guiding the conductors within each of said planar arrays toward one another and toward corresponding channels in said connector, and means for severing excess conductor ends from the main body of said conductors and thereafter urging the remaining ends of said unsheathed conductors into said connector slots.

2. Apparatus according to claim 1, wherein the individual conductors of said cable are each jacketed with an individual layer of insulation, characterized in that said means for severing an end portion of said sheathing material comprises a pair of spaced apart knife members each with a knife edge confronting the knife edge of the other with a gap between said edges substantially equal to the outside diameter of said individual conductor insulation, means for causing said knife members and said cable to translate relative to one another in the cable crosswise direction from a position with said knife members to one side of a side edge of the cable to a position with said knife members straddling the cable and penetrating the sheath of the cable, and means for thereupon causing said knife members and said cable to translate relative to one another in the cable lengthwise direction for stripping the severed sheath from the individually insulated conductors.

3. Apparatus according to claim 2, characterized in that said means for engaging said conductors comprises a pair of complementary comb-like members with tines having ends for engaging each a different one of the insulated conductors of a pair for separating said one conductor from its mate and urging the engaged conductor into a corresponding inter-tine slot on the opposite comb-like member as said comb-like members are brought together into overlapping relationship, all of said inter-tine slots having means for releasably retaining an insulated conductor therein, whereby upon separation of said comb-like members said conductors are separated into said two diverging planar arrays.

4. Apparatus according to claim 1, characterized in that said means for engaging said conductors comprises a pair of complementary comb-like members with tines having ends for engaging each a different one of the conductors of a pair for separating said one conductor from its mate and urging the engaged conductor into a corresponding inter-tine slot on the opposite comb-like member as said comb-like members are brought together into overlapping relationship, all of said inter-tine slots having means for releasably retaining a conductor therein, whereby upon separation of said comb-like members said conductors are separated into said two diverging planar arrays.

5. Apparatus according to claim 4, characterized in that each of said comb-like members comprises a thin flat blade with a contoured edge and a plurality of parallel equally spaced apart slots entering from said contoured edge and oriented normal to said edge; each said slot having an entrance section with parallel walls spaced apart a distance less than the outside diameter of one of said conductors but spaced sufficiently to permit one of said conductors to be pressed therebetween through said entrance section, and a retention section representing a continuation of said entrance section but having parallel walls spaced apart a distance greater than said outside diameter of one of said conductors; said comb-like members being mounted with confronting contoured edges for movement toward and into adjacent overlapping relationship, the slots on one member being interlaced relative to the slots on the other member such that a tine on one member overlaps a slot on the other member, and said contoured edge is shaped to separate adjacent conductors in said cable.

6. Apparatus according to claim 3, characterized in that each of said comb-like members comprises a thin flat blade with a contoured edge and a plurality of parallel equally spaced apart slots entering from said contoured edge and oriented normal to said edge; each said slot having an entrance section with parallel walls spaced apart a distance less than said outside diameter of said individual conductor insulation but spaced sufficiently to permit one of said insulated conductors to be pressed therebetween through said entrance section, and a retention section representing a continuation of said entrance section but having parallel walls spaced apart a distance greater than said outside diameter of said individual conductor insulation; said comb-like members being mounted with confronting contoured edges for movement toward and into adjacent overlapping relationship, the slots on one member being interlaced relative to the slots on the other member such that a tine on one member overlaps a slot on the other member, and said contoured edge is shaped to separate adjacent individually insulated conductors in said cable.

7. Apparatus according to claim 1, characterized in that said connector attaching station comprises means for grasping said connector with its cable attaching side facing outward, said grasping means including a series of parallel laterally spaced apart slots one of which overlies each conductor receiving slot in said connector such that said diverging arrays of conductors can be advanced in the lengthwise direction of the cable toward and centered upon said grasped connector for individual entry into a corresponding one of said grasping means slots, and means for simultaneously trimming the ends of said conductor and urging the remaining ends into the connector slots.

8. Apparatus according to claim 5, characterized in that said connector attaching station comprises means for grasping said connector with its cable attaching side facing outward, said grasping means including a series of parallel laterally spaced apart slots one of which overlies each conductor receiving slot in said connector such that said diverging arrays of conductors can be advanced in the lengthwise direction of the cable toward and centered upon said grasped connector for individual entry into a corresponding one of said grasping means slots, and means for simultaneously trimming the ends of said conductor and urging the remaining ends into the connector slots.

9. Apparatus according to claim 6, characterized in that said connector attaching station comprises means for grasping said connector with its cable attaching side facing outward, said grasping means including a series of parallel laterally spaced apart slots one of which overlies each conductor receiving slot in said connector such that said diverging arrays of conductors can be advanced in the lengthwise direction of the cable toward and centered upon said grasped connector for individual entry into a corresponding one of said grasping means slots, and means for simultaneously trimming the ends of said conductor and urging the remaining ends into the connector slots.

* * * * *